US006851131B1

(12) United States Patent
Adams

(10) Patent No.: US 6,851,131 B1
(45) Date of Patent: Feb. 8, 2005

(54) PORTABLE TOILET BOWL COVER

(76) Inventor: Tiffany Adams, 18039 S. Kedzie Ave., Homewood, IL (US) 60430

( * ) Notice: Subject to any disclaimer, the term of this patent is extended or adjusted under 35 U.S.C. 154(b) by 0 days.

(21) Appl. No.: 10/810,226

(22) Filed: Mar. 26, 2004

(51) Int. Cl.[7] ..... A47K 13/14
(52) U.S. Cl. ..... 4/245.1; 4/245.7
(58) Field of Search ..... 4/245.1, 245.3–245.8

(56) References Cited

U.S. PATENT DOCUMENTS 1,221,661 A * 4/1917 Bloch ..... 4/245.8
1,377,541 A * 5/1921 Young ..... 4/245.9
1,482,749 A * 2/1924 Juline ..... 4/245.9
1,522,699 A * 1/1925 Reid ..... 4/245.8
1,830,344 A * 11/1931 Akesson ..... 4/245.8
5,557,809 A * 9/1996 Adams ..... 4/245.3
5,729,838 A * 3/1998 Schweizer ..... 4/245.8

* cited by examiner

*Primary Examiner*—David J. Walczak
*Assistant Examiner*—Huyen Le
(74) *Attorney, Agent, or Firm*—Goldstein Law Offices, P.C.

(57) ABSTRACT

A portable toilet bowl cover, for selectively and substantially covering an existing toilet bowl, in order to prevent waste which may be present on portions of the toilet bowl from contacting the skin and clothing of an individual who sits upon the seat of the toilet bowl. The toilet bowl cover comprises a circular central seat pad having a left flap, a right flap, a front flap, and a back flap extending therefrom. The left flap and the right flap each have pockets for selectively storing various toiletries. In use, the central seat pad covers the seat of the toilet bowl, and the flaps substantially cover the bowl portion and the lid of the toilet bowl, thereby preventing waste material present upon the seat, the bowl portion, and the lid from coming into contact with the individual seated upon the toilet seat.

8 Claims, 5 Drawing Sheets

PORTABLE TOILET BOWL COVER

BACKGROUND OF THE INVENTION

1. Field of the Invention

The invention generally relates to an accessory for an existing toilet bowl, and in particular it relates to a portable toilet bowl cover for selectively and substantially covering an existing toilet bowl, in order to prevent waste which may be present on portions of the toilet bowl from contacting the skin and clothing of an individual seated upon the toilet bowl.

2. Description of the Related Art

An individual who needs to use a bathroom while away from home may need to use a public restroom. Although public restrooms are extremely useful and convenient, they have notable disadvantages. In particular, the toilet bowls within public restrooms are often cleaned only infrequently, and the toilet seat, the bowl portion, and the lid of the toilet bowl may become soiled with feces or urine, thereby making sitting upon the toilet bowl an unpleasant and unsanitary experience. Accordingly, there is a need for a toilet bowl cover for selectively covering the toilet seat, the bowl portion, and the lid of an existing toilet bowl prior to an individual sitting on the toilet seat, in order to prevent waste which may be present on the toilet bowl from contacting the skin and clothing of an individual who sits upon the seat.

A variety of disposable toilet seat covers have been devised for use in conjunction with an existing toilet bowl. However, these generally cover only the toilet seat of the toilet bowl, and are useless for preventing waste material present on other portions of the toilet bowl from coming into contact with the skin or clothing of an individual seated upon the seat of the toilet bowl. While these devices may be suitable for the particular purpose employed, or for general use, they would not be as suitable for the purposes of the present invention as disclosed hereafter.

SUMMARY OF THE INVENTION

It is an object of the invention to provide a toilet bowl cover for selectively and substantially covering an existing toilet bowl, in order to prevent waste which may be present on portions of the toilet bowl from contacting the skin and clothing of an individual who sits upon the seat of the toilet bowl. Accordingly, the toilet bowl cover has a central seat pad having four flaps extending therefrom. In use, the central seat pad completely covers the seat, and the flaps substantially cover the bowl portion and the lid, thereby preventing waste material present upon the seat, the bowl portion, and the lid from coming into contact with the skin and clothing of an individual who sits upon the seat of the toilet bowl.

It is another object of the invention to provide a toilet bowl cover that is portable. Accordingly, the toilet bowl cover may be compactly folded in order that it may be easily carried between locations.

It is yet another object of the invention to provide a toilet bowl cover that is easy to use. Accordingly, the toilet bowl cover is simply unfolded and lowered upon the toilet bowl prior to a user sitting down upon the toilet seat.

It is an additional object of the invention to provide a toilet bowl cover that may be additionally used for storing various toiletries. Accordingly, the toilet bowl cover has a right flap and a left flap, each having three pockets which are selectively used for storing various toiletries.

It is another object of the invention to provide a toilet bowl cover that is durable. Accordingly, the central seat pad and a back flap of the toilet bowl cover are three-ply, and comprise an upper plastic layer, a lower plastic layer, and a cardboard insert sandwiched therebetween. The three-ply structure confers additional durability to the central seat pad and the back flap.

Further objects of the invention will become apparent in the detailed description of the invention that follows.

The invention is a portable toilet bowl cover, for selectively and substantially covering an existing toilet bowl, in order to prevent waste which may be present on portions of the toilet bowl from contacting the skin and clothing of an individual who sits upon the seat of the toilet bowl. The toilet bowl cover comprises a circular central seat pad having a left flap, a right flap, a front flap, and a back flap extending therefrom. The left flap and the right flap each have pockets for selectively storing various toiletries. In use, the central seat pad covers the seat of the toilet bowl, and the flaps substantially cover the bowl portion and the lid of the toilet bowl, thereby preventing waste material present upon the seat, the bowl portion, and the lid from coming into contact with the individual seated upon the toilet seat.

To the accomplishment of the above and related objects the invention may be embodied in the form illustrated in the accompanying drawings. Attention is called to the fact, however, that the drawings are illustrative only. Variations are contemplated as being part of the invention, limited only bye the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
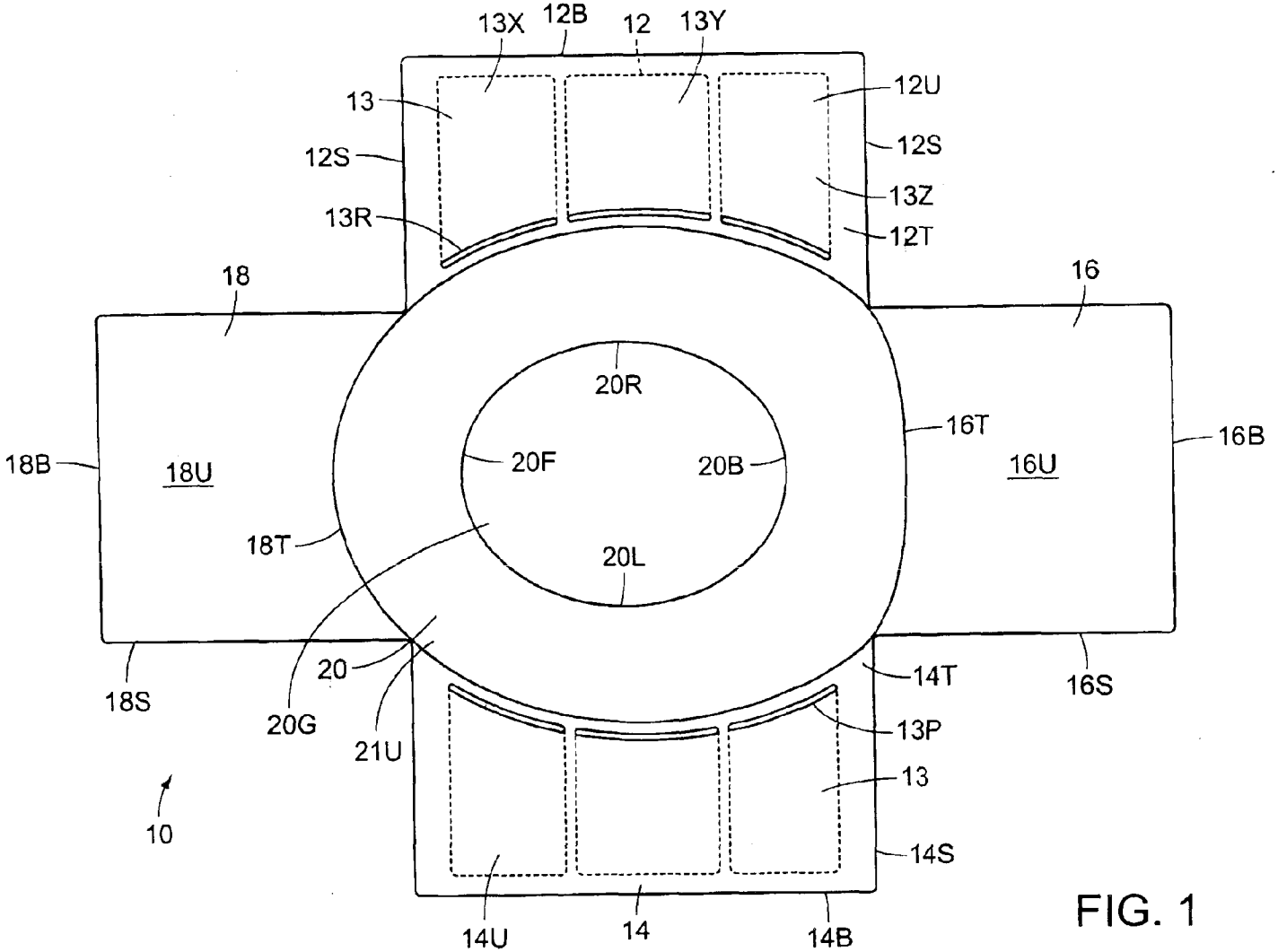
FIG. 1 is a top elevational view of a portable toilet bowl cover in an unfolded position, having a circular central seat pad having four flaps extending therefrom.

FIG. 1 illustrates a portable toilet bowl cover 10, for use in conjunction with an existing toilet bowl of a public restroom, for selectively covering a toilet seat and other portions of the toilet bowl. The toilet bowl cover 10 prevents waste and germs which may be present on the seat and other portions of the toilet bowl from coming into contact with the skin or clothing of an individual sitting upon the toilet seat. The toilet bowl cover 10 comprises a circular central seat pad 20 having four arcuate edge portions, namely, a front edge portion 20F, a back edge portion 20B, a left edge portion 20L, and a right edge portion 20R. Each of said arcuate edge portions has a different flap extending therefrom. In particular, the front edge portion 20F has a front flap 18 extending therefrom, the back edge portion 20B has a back flap 16 extending therefrom, the left edge portion 20L has a left flap 14 extending therefrom, and the right edge portion 20R has a right flap 12 extending therefrom.

Each of the flaps, 12, 14, 16, and 18, has an upper surface, 12U, 14U, 16U, and 18U, respectively. Each of the flaps, 12, 14, 16, and 18, also has a lower surface. The upper surfaces, 12U, 14U, 16U, and 18U, are visible in FIG. 1. Each of the flaps, 12, 14, 16, and 18, has an arcuate top, two sides, and a bottom. In particular, the right flap 12 has an arcuate top 12T, two sides 12S, and a bottom 12B. In like manner, the left flap 14 has an arcuate top 14T, two sides 14S, and a bottom 14B. Also, the front flap 18 has an arcuate top 18T, two sides 18S, and a bottom 18B. Also, the back flap 16 has an arcuate top 16T, two sides 16S, and a bottom 16B. The flaps, 12, 14, 16, and 18, are attached at their tops 12T, 14T, 16T, and 18T, respectively, to the central seat pad 20.

The toilet bowl cover 10 has a folded and an unfolded position. FIG. 1 illustrates the toilet bowl cover 10 in the unfolded position, wherein each of the flaps, 12, 14, 16, and 18, has been extended away from the seat pad 20. The toilet bowl cover 10 is transported while in the more compact folded position, wherein the flaps, 12, 14, 16, and 18, are folded substantially flat against the seat pad 20.

Figure 3:
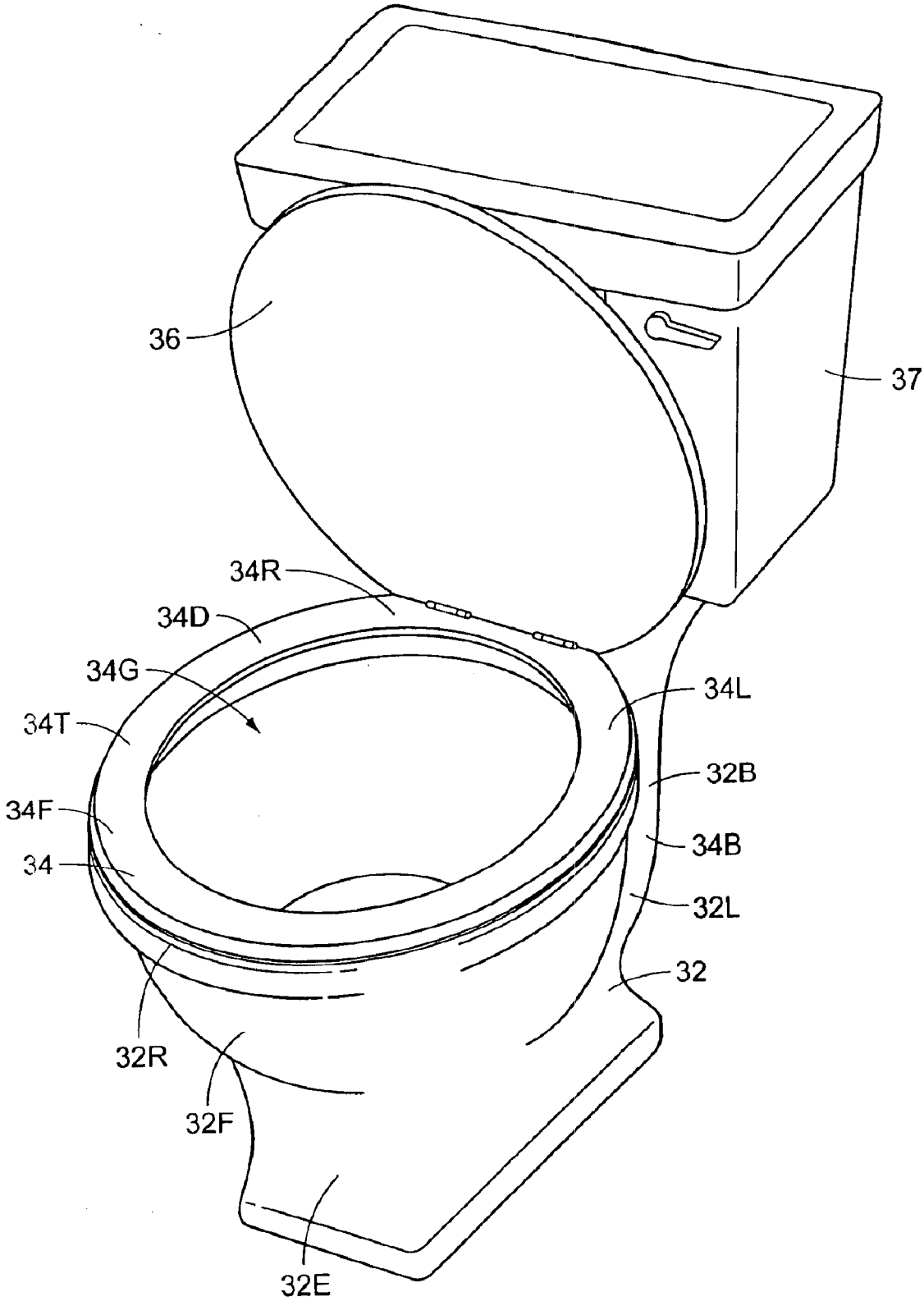
FIG. 3 is a perspective view of an existing toilet bowl.

FIG. 3 illustrates an existing toilet bowl 30. The toilet bowl 30 has a bowl portion 32 having a circular rim 32R. The bowl portion 32 has an external surface 32E, a front 32F, a back 32B, a left side 32L, and a right side. The toilet bowl 30 has a substantially circular seat 34 hingeably attached to the bowl portion 32 in proximity to the back 32B of the bowl portion 32. The toilet bowl 30 has a substantially circular lid 36 that selectively covers the seat 34 when the toilet bowl 30 is not being used. The seat 34 has a top 34T, a bottom 34B, a front 34F, a back 34R, a left side 34L, a right side 34D, and a central opening 34G. The seat 34 has a raised position wherein the seat 34 has been lifted away from the rim 32R of the bowl portion 32, and a lowered position wherein the seat 34 has been lowered upon the rim 32R of the bowl portion 32. In FIG. 1, the seat 34 is in the lowered position. The toilet bowl 30 has an associated water tank 37 that selectively supplies the water necessary for the operation of the toilet bowl 30. The lid 36 has been swiveled away from the seat 34 and rests against the water tank 37.

Figure 4:
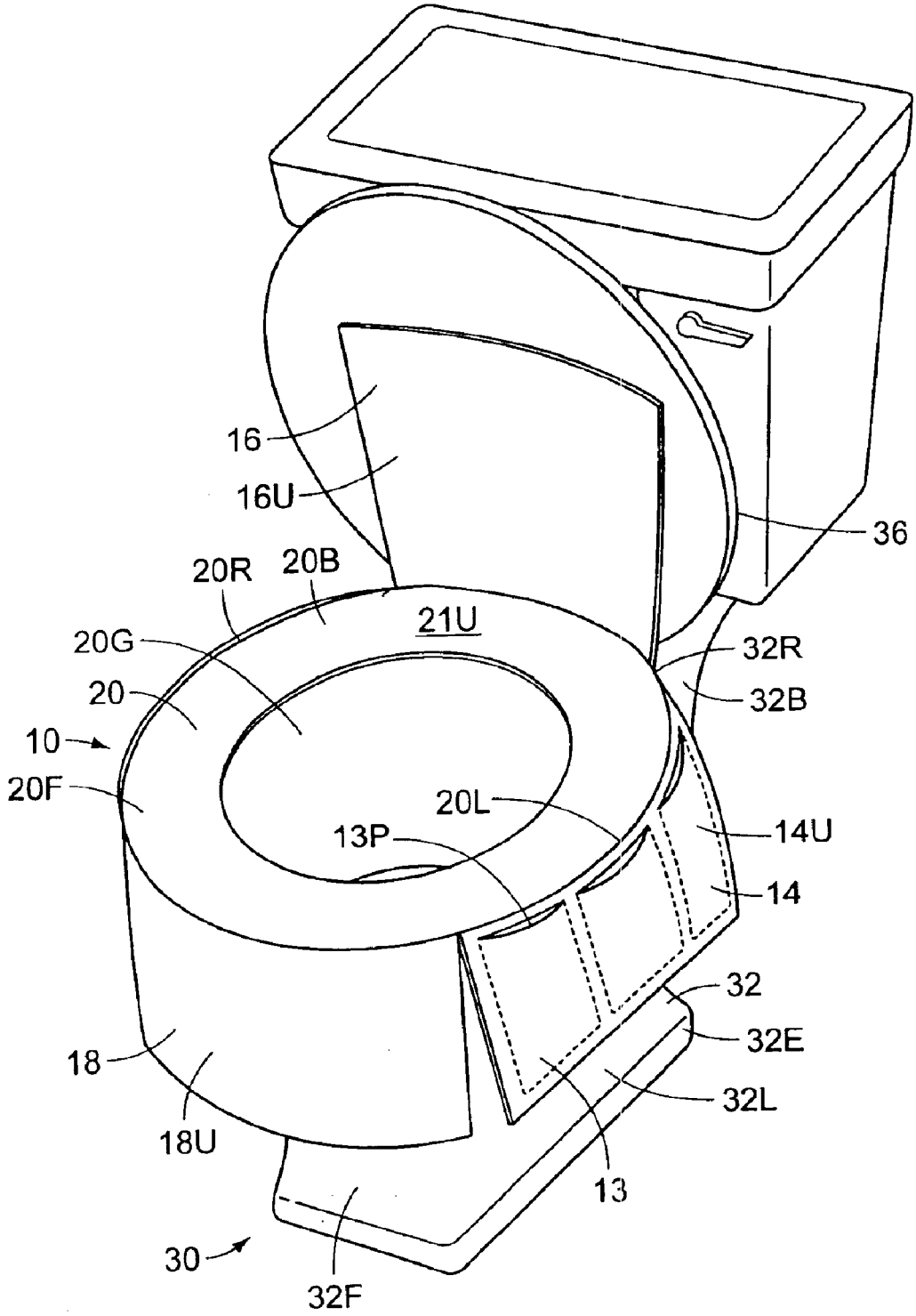
FIG. 4 is a perspective view of the portable toilet bowl cover being used in conjunction with the toilet bowl.

FIG. 4 illustrates the portable toilet bowl cover 10 being utilized in conjunction with the toilet bowl 30. The upper surfaces, 12U, 14U, 16U, and 18U, of the flaps, 12, 14, 16, and 18, respectively, are visible. The upper surface 12U of the right flap 12 is not visible in this view. Various portions of the toilet bowl 30 are completely or substantially covered by the toilet bowl cover 10. More particularly, the seat 34 is completely covered by the central seat pad 20, the front 32F of the bowl portion 32 is substantially covered by the front flap 18, the left side 32L of the bowl portion 32 is substantially covered by the left flap 14, and the right side 32D of the bowl portion 32 is substantially covered by the right flap 12. Moreover, the lid 36 is substantially covered by the back flap 16. Accordingly, the toilet bowl cover 10 protects the skin and clothing of an individual seated upon the toilet bowl 30 from waste material present on the seat 34, the bowl portion 32, and also the lid 36.

Figure 5:
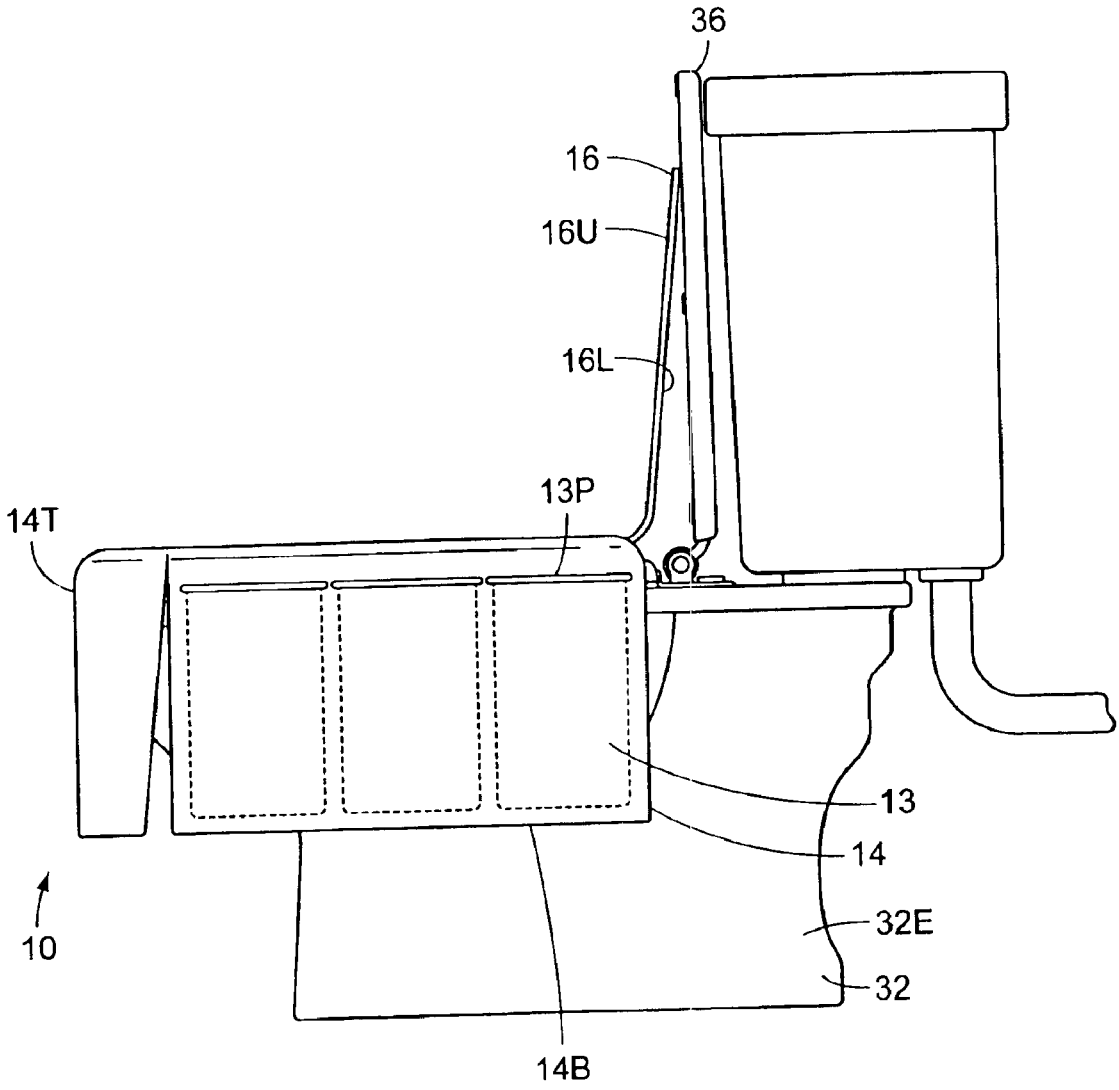
FIG. 5 is a side view of the portable toilet bowl cover being used in conjunction with the toilet bowl.

FIG. 5 illustrates a side view of the portable toilet bowl cover 10 being used in conjunction with the toilet bowl 30.

Returning to FIG. 1, the upper surface 12U of the right flap 12 has three vertical pockets 13, each of which extend substantially from the top 12T to the bottom 12B of the right flap 12, and each having an opening 13P in proximity to the top 12T of the right flap 12. In like fashion, the upper surface 14U of the left flap 14 has three vertical pockets 13, each of which extend substantially from the top 14T to the bottom 14B of the left flap 14, and each having an opening 13P in proximity to the top 14T of the left flap 14. Each of the flaps, 12 and 14, has a proximal pocket 13X closer to the front 32F of the bowl portion 32 while the toilet bowl cover 10 is being deployed, a distal pocket 13Z closer to the back 32B of the bowl portion 32 while the toilet bowl cover 10 is being deployed, and a middle pocket 13Y sandwiched therebetween. The pockets 13 are used for selectively holding various toiletries, as will be described.

Figure 2:
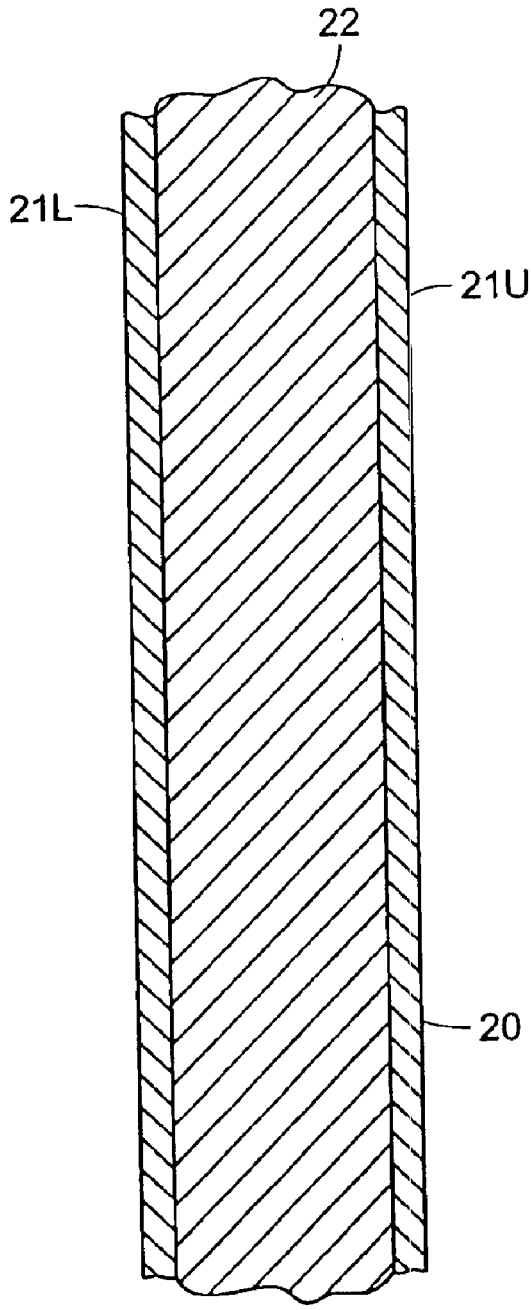
FIG. 2 is a cross-sectional view through a portion of the central seat pad.

Turning to FIG. 2, the seat pad 20 has a three-ply structure, comprising an upper plastic layer 21U, a lower plastic layer 21L, and a cardboard insert 32 sandwiched therebetween. Returning momentarily to FIG. 4, the upper plastic layer 21U of the seat pad 20 is visible while the toilet bowl cover 10 is being deployed. The back flap 16 has a substantially identical three-ply structure. The three-ply structure of the seat pad 20 and the back flap 16 confers additional rigidity to the seat pad 20 and the back flap 16. This feature makes the toilet bowl cover 10 more durable and long lasting. Moreover, this feature allows the back flap 16 to remain substantially rigid and upright in order that it may rest against the lid 36 of the toilet bowl 30 while the toilet bowl cover 10 is being deployed. The front flap 18, the right flap 12, and the left flap 14, are preferably constructed from a flexible plastic material, so that they will hang down and cover the bowl portion 32 while the toilet bowl cover 10 is being deployed.

It is contemplated that in the left flap 14, the proximal pocket 13X may be used for selectively storing babywipes, the middle pocket 13Y may be used for selectively storing a disposable pack of tissue paper, and the distal pocket 13Z may be used for selectively storing folded paper towels. It is further contemplated that in the right flap 12, the proximal pocket 13X may be used for selectively storing liquid hand sanitizer, the middle pocket 13Y may be used for selectively storing liquid antibacterial soap, and the distal pocket 13Z may be used for selectively storing an antibacterial surface spray, such as Lysol brand disinfectant. As described, the toilet bowl cover 10 is not provided with the aforementioned toiletries. However, in an alternate embodiment of the invention, the toilet bowl cover 10 is provided as a kit that includes said toiletries.

In use, a user carries a folded portable toilet bowl cover 10 when leaving the home, particularly when the user anticipates that a need for a public restroom may arise. Before sitting down upon a seat 34 of a toilet bowl 30 of the substantially covers the toilet bowl 30 with the cover 10. In particular, the user overlays the circular central seat pad 20 over the toilet seat 34, with the front edge portion 20F positioned above the front 34F of the toilet seat 34, the back edge portion 20B positioned above the back 34R of the toilet seat 34, the left edge portion 20L positioned above the left side 34L of the toilet seat 34, and the right edge portion 20R positioned above the right side 34D of the toilet seat 34. The user vertically lowers the lower plastic layer 21L of the seat pad 20 onto the toilet seat 34, and allows the right flap 12, the left flap 14, and the front flap 18 to hang down and substantially cover the right side 32D of the bowl portion 32, the left side 32L of the bowl portion 32, and the front 32F of the bowl portion 32, respectively. The back flap 16 is used to substantially cover the lid 36. The user then sits upon the toilet bowl seat 34, and uses the toilet bowl 30 in the usual fashion. The user removes various toiletries from the pockets 13, as needed. After use of the toilet bowl 30 is completed, the user once again folds the toilet bowl cover 10, and carries it upon exiting the restroom.

In conclusion, herein is presented a portable toilet bowl cover for use in conjunction with an existing toilet bowl, for preventing the spread of waste materials and germs from the toilet bowl to an individual sitting upon the seat of the toilet bowl. The invention is illustrated by example in the drawing figures, and throughout the written description. It should be understood that numerous variations are possible, while adhering to the inventive concept. Such variations are contemplated as being a part of the present invention.

What is claimed is:

1. A portable toilet bowl cover, for use by a user, in conjunction with an existing toilet bowl of a public restroom, for selectively covering portions of the toilet bowl, in order to prevent waste and germs present on said portions of the toilet bowl from contacting the skin or clothing of the user while sitting upon the toilet bowl, said toilet bowl having a bowl portion having a rim, a front, a back, a left side, and a right side, said toilet bowl also having a substantially circular seat hingeably attached to the bowl portion in proximity to the back of the bowl portion, and a lid for selectively covering the seat while the toilet bowl is not being used, said seat having a top, a bottom, a front, a back, a left side, a right side, and a central opening, said seat having a raised position wherein the seat has been lifted away from the rim of the bowl portion, and a lowered position wherein the seat has been lowered upon the rim of the bowl portion, said toilet bowl cover comprising:

a central seat pad having a front edge portion, a back edge portion, a left edge portion, and a right edge portion, wherein the front edge portion has a front flap extending therefrom, the back edge portion has a back flap extending therefrom, the left edge portion has a left flap extending therefrom, and the right edge portion has a right flap extending therefrom, wherein the back flap has a three-ply structure, comprising an upper plastic layer, a lower plastic layer, and a cardboard insert sandwiched therebetween, for conferring additional rigidity to the back flap, for making the toilet bowl cover more durable, and for allowing the back flap to remain substantially upright in order that it may rest against the lid of the toilet bowl while the toilet bowl cover is being deployed, wherein each of the flaps has an upper surface, a lower surface, an arcuate top, two sides, and a bottom, and wherein the flaps are attached at their tops to the central seat pad; and wherein the toilet bowl cover has an unfolded position wherein each of the flaps is extended away from the seat pad, and has a folded position wherein each of the flaps is folded substantially flat against the seat pad in order that the toilet bowl cover will be compact and easily transported.

2. The portable toilet bowl cover as recited in claim 1, wherein the upper surface of the right flap and the upper surface of the left flap each have three pockets extending substantially from the top to the bottom of said flaps, and each having an opening in proximity to the top of the right flap, wherein each of said flaps has a proximal pocket closer to the front of the bowl portion while the toilet bowl cover is being deployed, a distal pocket closer to the back of the bowl portion while the toilet bowl cover is being deployed, and a middle pocket sandwiched therebetween, said pockets for selectively holding existing toiletries.

3. The portable toilet bowl cover as recited in claim 2, wherein the seat pad has a three-ply structure, comprising an upper plastic layer, a lower plastic layer, and a cardboard insert sandwiched therebetween, for conferring additional rigidity to the seat pad, and for making the toilet bowl cover more durable.

4. The portable toilet bowl cover as recited in claim 3, wherein the lower plastic layer of the seat pad rests upon the seat while the toilet bowl cover is being deployed, and wherein the upper surfaces of the flaps and the upper plastic layer of the seat pad are visible while the toilet bowl cover is being deployed.

5. The portable toilet bowl cover as recited in claim 4, wherein while being utilized to selectively cover portions of the toilet bowl, the seat is completely covered by the central seat pad, the front of the bowl portion is substantially covered by the front flap, the left side of the bowl portion is substantially covered by the left flap, the right side of the bowl portion is substantially covered by the right flap, and the lid is substantially covered by the back flap, in order that the toilet bowl cover protects the skin and clothing of the user seated upon the toilet bowl from waste material present on the seat, the bowl portion, and the lid.

6. The portable toilet bowl cover as recited in claim 5, wherein the front flap, the right flap, and the left flap, are constructed from a flexible plastic material, so that they will hang down and cover the bowl portion while the toilet bowl cover is being deployed.

7. The portable toilet bowl cover as recited in claim 6, wherein the central seat pad is substantially circular.

8. A method of preventing waste and germs present upon an existing toilet bowl of a public restroom from contacting the skin and clothing of a user while sitting upon the toilet bowl, said toilet bowl having a seat having a front, a back, a left side, and a right side, said toilet bowl further having a bowl portion having a right side, a left side, a front, and a back, said toilet bowl further having a lid, said method utilizing a portable toilet bowl cover which may be selectively folded, said toilet bowl cover having a central seat pad having a front edge portion, a back edge portion, a left edge portion, a right edge portion, and a lower layer, said central seat pad having a right flap, a left flap, a front flap, and a back flap extending therefrom, said method comprising the steps of:

carrying a folded portable toilet bowl cover by the user when the need for a public restroom may arise;

unfolding the toilet bowl cover prior to sitting down on the seat of the toilet bowl;

positioning the central seat pad over the toilet seat, with the front edge portion positioned above the front of the toilet seat, the back edge portion positioned above the back of the toilet seat, the left edge portion positioned above the left side of the toilet seat, and the right edge portion positioned above the right side of the toilet seat;

substantially covering the toilet bowl with the toilet bowl cover by vertically lowering the lower layer of the seat pad onto the toilet seat, and allowing the right flap, the left flap, and the front flap to hang down and substantially cover the right side of the bowl portion, the left side of the bowl portion, and the front of the bowl portion, respectively, and covering the lid with the back flap, and thereby preventing the waste and germs present on the bowl portion, the seat, and the lid from contacting the skin or clothing of the user while sitting upon the toilet bowl;

folding the toilet bowl cover after use of the toilet bowl is completed; and carrying the toilet bowl cover by the user upon exiting the restroom.

* * * * *